US006634831B2

(12) United States Patent
Canteri

(10) Patent No.: US 6,634,831 B2
(45) Date of Patent: Oct. 21, 2003

(54) METHOD FOR INCREASING THE BEARING CAPACITY OF FOUNDATION SOILS FOR BUILT STRUCTURES

(75) Inventor: Carlo Canteri, Brunate (IT)

(73) Assignee: Uretek Worldwide Oy, Tampere (FI)

( * ) Notice: Subject to any disclaimer, the term of this patent is extended or adjusted under 35 U.S.C. 154(b) by 0 days.

(21) Appl. No.: 09/308,962

(22) PCT Filed: Nov. 27, 1997

(86) PCT No.: PCT/EP97/06619

§ 371 (c)(1),
(2), (4) Date: Sep. 2, 1999

(87) PCT Pub. No.: WO98/24982

PCT Pub. Date: Jun. 11, 1998

(65) Prior Publication Data

US 2002/0098042 A1 Jul. 25, 2002

(30) Foreign Application Priority Data

Dec. 2, 1996 (IT) ..... MI96A2520

(51) Int. Cl.[7] ..... E02D 3/12
(52) U.S. Cl. ..... 405/264; 52/742.13; 405/263
(58) Field of Search ..... 405/263, 264, 405/266, 270, 258.1, 271, 269; 52/742.13, 742.14

(56) References Cited

U.S. PATENT DOCUMENTS

| | | | | |
|---|---|---|---|---|
| 2,627,169 A | | 2/1953 | Poulter | |
| 3,719,050 A | * | 3/1973 | Asao et al. | 405/264 |
| 3,878,686 A | | 4/1975 | Hageman et al. | |
| 4,113,014 A | * | 9/1978 | Kubens et al. | 405/264 |
| 4,114,382 A | * | 9/1978 | Kubens et al. | 405/264 |

(List continued on next page.)

FOREIGN PATENT DOCUMENTS

| | | | | |
|---|---|---|---|---|
| DE | A-3332256 | | 9/1984 | |
| DE | 3921938 | | 1/1991 | |
| DE | 4137359 | | 5/1993 | |
| EP | A-0264998 | | 4/1988 | |
| HU | 203799 | | 7/1984 | |
| HU | 212073 | | 11/1990 | |
| IT | 1210195 | | 9/1989 | |
| JP | 5272126 | | 10/1993 | |
| JP | 405320644 | * | 12/1993 | 405/266 |
| JP | 8260500 | | 10/1996 | |
| WO | PCT/IT89/00020 | | 10/1990 | |

OTHER PUBLICATIONS

Magazine "Modulo", No. 206, Nov. 1994, p. 1128.
Magazine "Edilizia Specializzata", No. 22, Mar. 1993, p. 85.
Magazine "L'Edilizia" No. 5, May 1994, p. 29.
B1: "Macchine E Materiali" (Quarry and Construction), pp. 36–37, Jun. 1994.
B2: "Macchine E Materiali" (Quarry and Construction), pp. 29–30, Apr. 1993, + Translation of the outlined parts.
B3: "Prefabbricati & Strutture" (Quarry and Construction), pp. 119–121, Aug. 1996, + Translation of the outlined parts.
B4: "Le Strade" No. 6/95, pp. 447–449, Jun. 1995 + Translation of the outlined parts.

(List continued on next page.)

*Primary Examiner*—Robert E. Pezzuto
*Assistant Examiner*—Alexandra K. Pechhold
(74) *Attorney, Agent, or Firm*—Daniel O'Byrne

(57) ABSTRACT

A method for increasing the bearing capacity of foundation soils for built structures consisting of providing a plurality of holes spaced from each other deep in the soil, and injecting into the soil, through the holes, a substance which expands as a consequence of a chemical reaction, with a potential increase in volume of at least five times the volume of the substance before expansion. The expansion of the substance injected into the soil produces compaction of the contiguous soil.

23 Claims, 6 Drawing Sheets

U.S. PATENT DOCUMENTS

| | | | | | |
|---|---|---|---|---|---|
| 4,307,980 | A | * | 12/1981 | Meyer et al. | 405/264 |
| 4,391,926 | A | * | 7/1983 | Creyf | 405/264 |
| 4,452,551 | A | * | 6/1984 | Arndt et al. | 405/264 |
| 4,454,252 | A | * | 6/1984 | Meyer | 405/264 |
| 4,475,847 | A | * | 10/1984 | Cornely et al. | 405/264 |
| 4,567,708 | A | | 2/1986 | Haekkinen | |
| 4,575,391 | A | * | 3/1986 | DeBoodt et al. | 405/264 |
| 4,715,746 | A | * | 12/1987 | Mann et al. | 405/264 |
| 4,744,700 | A | | 5/1988 | Andy et al. | |
| 4,761,099 | A | * | 8/1988 | Mann et al. | 405/264 |
| 4,832,535 | A | * | 5/1989 | Crambes | 405/266 |
| 4,904,125 | A | * | 2/1990 | Schmidt et al. | 405/264 |
| 5,306,104 | A | | 4/1994 | Witherspoon | |
| 5,401,121 | A | | 3/1995 | Nakashima et al. | |
| 5,436,396 | A | * | 7/1995 | Bailey et al. | 523/130 |

OTHER PUBLICATIONS

B5: "Costruzioni, Tecnica Ed Organizzazione Dei Cantieri", No. 467 + Translation of the outlined parts (Intervention Phases).

B6: "Costruzioni", Mar. 1996, p. 288 + Translation of the outlined parts.

B7: Uretek, Letter dated Aug. 16, 1996 + Translation of the outlined parts.

B8: Uretek, Letter dated Jan. 31, 1995 + Translation of the outlined parts.

B9: Uretek, Letter dated Oct. 24, 1995 + Translation of the outlined parts.

B10: "Tecnologie Di Consolidamento Delle Strutture Murarie", 1990, pp. 50–57, + Translation of the outlined parts.

B11: "IL Manuale Del Geologo" 1995, pp. 388–397, + Translation of the outlined parts.

* cited by examiner

METHOD FOR INCREASING THE BEARING CAPACITY OF FOUNDATION SOILS FOR BUILT STRUCTURES

BACKGROUND OF THE INVENTION

The present invention relates to a method for increasing the bearing capacity of foundation soils for built structures, including buildings, roadway slabs, airport runaways and equipment supporting slabs.

Any building requires the foundation soil to have a sufficient bearing capacity to support it. Otherwise, the settling of the foundation soil leads to the failure of the overlying building, regardless of whether the settling occurs in the uppermost or in the deep layers.

Before erecting any building, the bearing capacity of the soil is therefore estimated according to the weight or load which the building will apply to the soil, even using, if necessary, appropriate soil research, such as for example geological and geotechnical research.

In order to ensure the stability of the structure, the optimum dimensions of the foundations and their rigidity are calculated and the depth of the foundations is also determined, adequately balancing their weight in relation to the bearing capacity of the soil and always maintaining a good safety margin. In case of error, the building may in fact fail.

Often, however, the bearing capacity of the foundation soil is not sufficient, since the soil is compressible, as in the case of filled-in land, non-consolidated land, land with decomposing organic layers, peaty land, swampy land, land with considerable variations in water content, flooded or washed-out land with voids or with non-uniform or insufficiently aggregated masses, land with interstitial voids, et cetera; or the building is very heavy and requires a greater bearing capacity than the actual bearing capacity of the foundation soil.

Various conventional systems ensure in any case the stability of the building. Generally, these systems tend to directly transfer the weight of the building to the deeper and adequately solid soil layers or to spread the load over a wide ground surface, such as for example the method consisting in driving piles or micropiles and the like into the foundation soil. This method can be used both before and after construction.

Of course, the driving of piles and micropiles or the like after the construction of the building is extremely complicated and expensive.

Conventional methods also cope with any subsidence of the building after its construction, such as for example the method described in U.S. Pat. No. 4,567,708, which entails the injection of an expandable substance beneath the building to fill the interstices which have formed and have caused the subsidence and in order to recover the subsidence of the building, or other lifting methods.

In the method disclosed in the above-cited patent, as well as in other lifting systems, however, the foundation soil is not treated; at the most, one acts on the surface layers of the soil, and therefore if the underlying soil has not settled enough, further subsequent subsidence of said building will occur over time.

A method for ground consolidation using, an expandable substance, in which the expansion time is controlled to be slow or very slow, is known from the document DE-A-33 32 256.

SUMMARY OF THE INVENTION

A principal aim of the present invention is to solve the above problems by providing a method capable of ensuring the stability of built structures, including buildings, roadway slabs, airport runaways and equipment supporting slabs, by adequately treating the foundation soil in order to increase its bearing capacity. The term "foundation soil" is intended to designate that part of the soil having influence on the overlying built structure or that the direct or indirect influence of the built structure (J. Collas and M Harvard, Manuale di Geotecnica, Faenza Editrice S. P. A., 1986).

Within the scope of this aim, an object of the present invention is to provide a method which does not require the use of cement, concrete, or metal structures driven into the ground, such as piles, micropiles, cement injections, very deep foundations, etcetera.

Another object of the present invention is to provide a method which is simple and easy to perform and can be adopted to increase the bearing capacity of foundation soils both before and after construction of the building.

This aim, these objects, and others which will become apparent hereinafter are achieved by a method for increasing the bearing capacity of foundation soils for built structures, according to the present invention, comprising the steps set forth in claims.

BRIEF DESCRIPTION OF THE DRAWINGS

Further characteristics and advantages of the present invention will become apparent from the following detailed description of a preferred but not exclusive embodiment of the method according to the invention, illustrated only by way of non-limitative example in the accompanying drawings, wherein.

DESCRIPTION OF THE PREFERRED EMBODIMENTS

Figure 1:
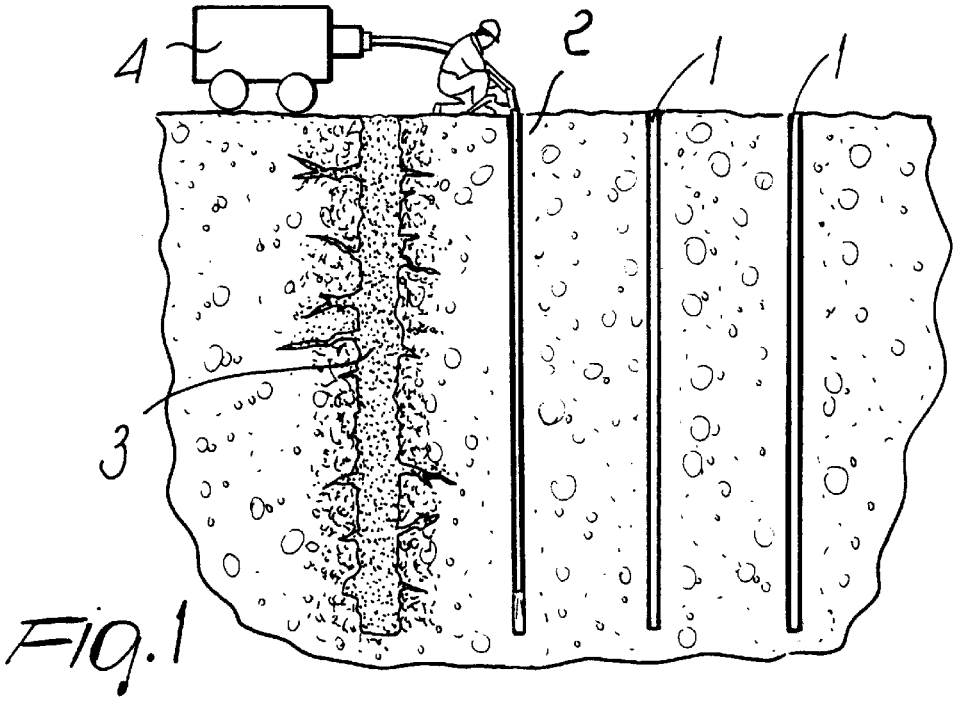
FIG. 1 is a schematic view of the injection of the expandable substance through holes formed in the soil.

The method according to the present invention substantially consists in forming in the soil a plurality of holes 1 which, if one must act on existing buildings, may or may not pass through the foundation, at different depths and preferably with a distance between two contiguous holes 1 which can vary between 0.5 m and 3 m.

The holes 1 can have variable dimensions according to requirements and can be provided substantially vertically or at an angle with respect to the vertical.

The depth of the holes may also vary according to requirements, as will become apparent hereinafter.

Tubes 2 are then inserted or driven into the holes 1 and a substance 3 expanding as a consequence of a chemical reaction between the components, with a potential volume increase of at least five times the volume of the substance before expansion, is injected into the soil through said tubes. The expression "potential volume increase" relates to the volume increase of the substance as a consequence of an expansion occurring unhindered at atmospheric pressure.

High expansion coefficients of 20–25 times the initial volume or even higher such as 30–33 may be preferred.

The expandable substance is conveniently constituted by a mixture of expandable polyurethane foam, preferably a closed-cell polyurethane foam. This substance can be constituted, for example, by a two-part foam mixed inside a mixing unit 4 connected to the injection tubes 2. The first component can be a mixture of polyols comprising a polyether polyol and/or a polyester polyol, a catalyst, such as RESINOL AL 643 produced by the Dutch company Resina Chemie, and water. The water in the composition may be 3.44% by weight. The second component can be an isocyanate MDI, such as URESTYL 10 manufactured by the same company. The mixing of these two components produces an expandable polyurethane foam the density whereof, at the end of expansion, varies according to the resistance opposed by the soil adjacent to the injection region.

The mixture may expand up to about 33 times its initial volume and the reaction time is of about 3–6 seconds, as it appears from the technical specifications of the manufacturer.

It is of course also possible to use other expandable substances having similar properties without thereby abandoning the scope of the protection of the present invention.

Figure 2:
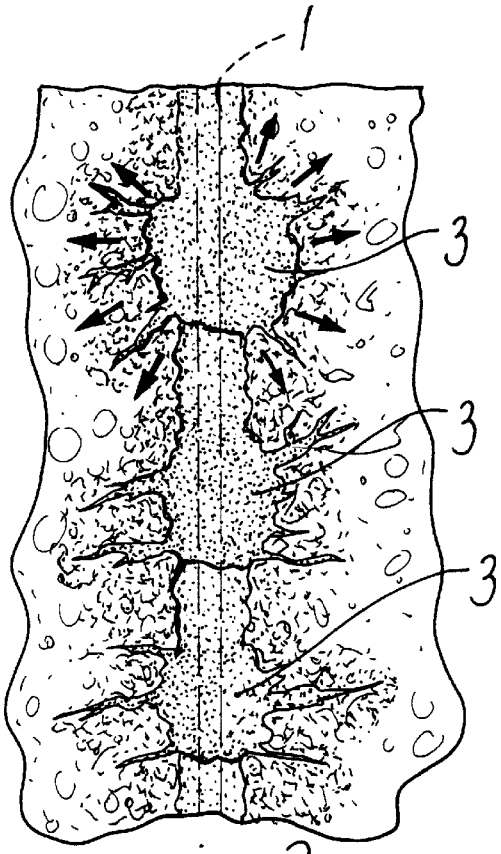
FIGS. 2 and 3 are views of the result of the expansion of the expandable substance when the substance is injected whilst the tube used for injection is gradually retracted upwards, respectively with pauses at intermediate depth levels or with a continuous motion.
Figure 3:
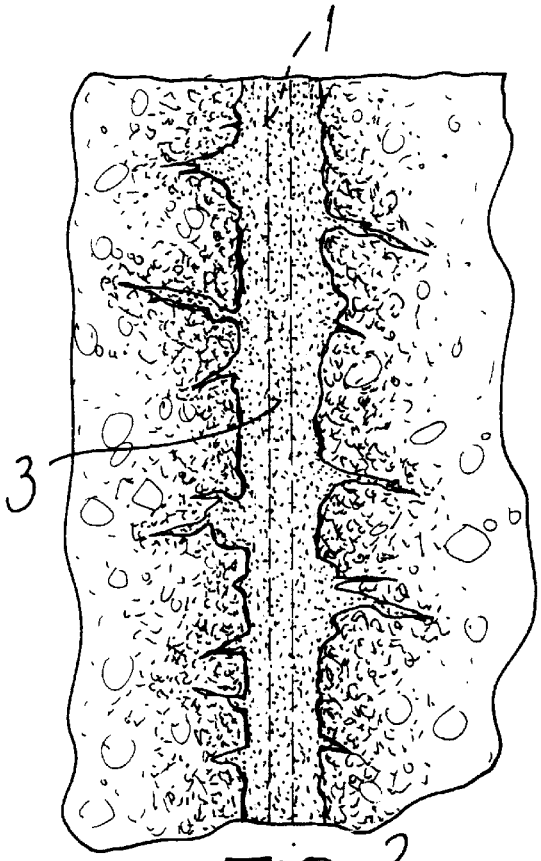
Figure 4:
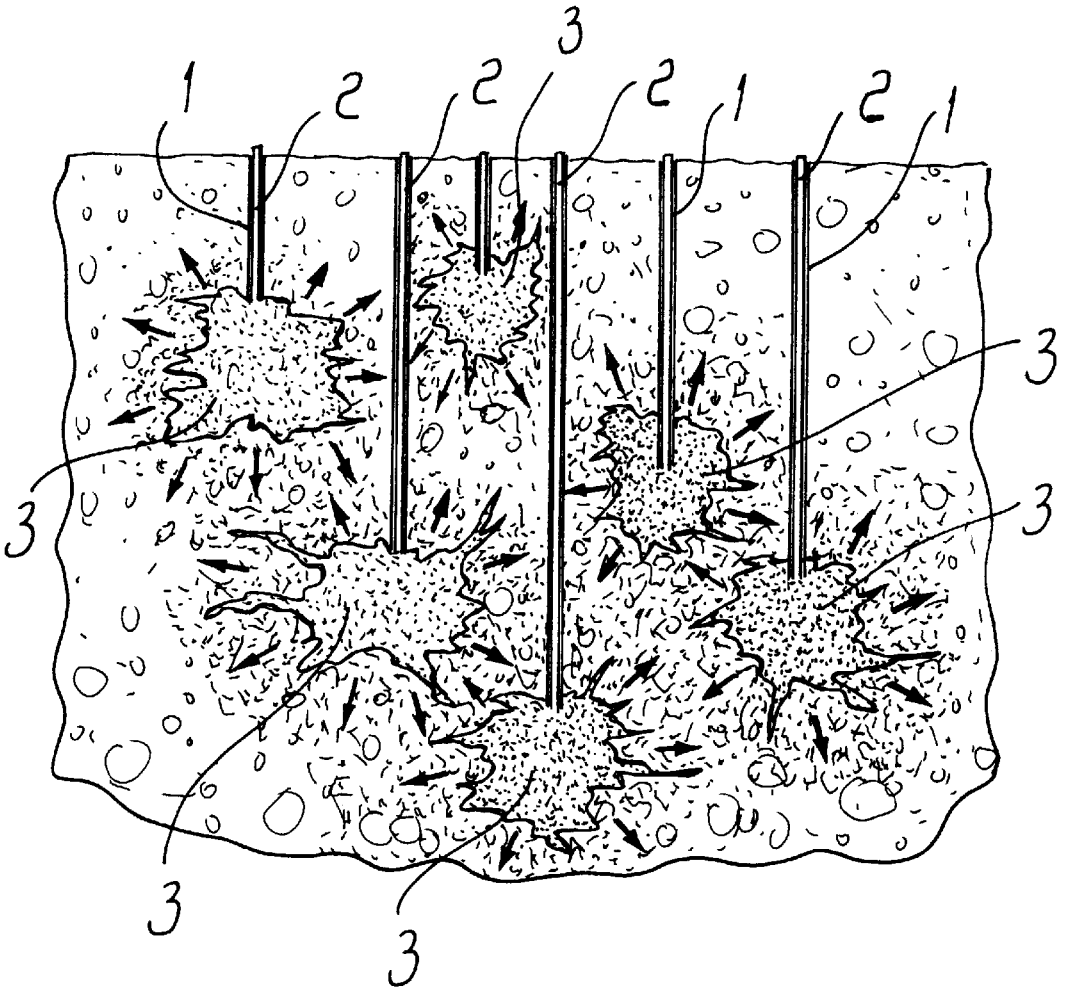
FIG. 4 is a view of the result of the expansion of the injected substance in the case of sequential injections performed with different tubes, inserted in different holes, in points spaced from each other and at different depths.

According to requirements, the expandable substance can be injected through the holes 1 formed beforehand in the soil in a single injection step, as shown in FIGS. 1, 2, and 3, starting from the bottom, whilst the injection tube is gradually retracted upwards, optionally with intermediate pauses, as shown in FIG. 2, so as to obtain different columns of hardened and expanded substance, or the substance can be injected, optionally by performing sequential injections at fixed and different depths in points which are three-dimensionally and uniformly spaced from each other so as to obtain regions of expanded and hardened substance within the foundation soil, as shown in particular in FIG. 4, according to requirements and according to the geological characteristics of the soil. In this last case, the tubes used for injection are left in the soil.

Once the substance 3 has been injected, since it has also penetrated in any voids and fractures of the soil thanks to its fluidity, expanding with great force and speed in all directions, it generates a force which compacts and compresses the soil all around, eliminating by compression or filling all voids and microvoids, even extremely small ones, expelling most of the water impregnating the soil, possibly agglomerating loose parts (granules and noncohesive parts) until a mass of soil is obtained which, throughout the treated layer, can no longer be compressed in relation to the weight that it has or will have to bear.

It should be noted that the expandable substance injected at different depths, in appropriately calculated points having a specific distance from each other, or along ascending lines, during expansion automatically flows towards the more compressible points, which as such offer less resistance to the expandable substance. In this manner, the regions which most need treating are automatically treated more intensely, without leaving spaces with untreated regions.

The immediate nature of the expansion of the injected substance also allows to delimit the expansion region rather precisely, thus allowing to localize very well, in the intended points, the effect to be produced. The intense pressure applied by the injected substance to the surrounding soil is in fact due to the expansion caused by the chemical reaction and is not caused by hydraulic pressure. The expandable substance is injected through a hydraulic pressure which, however, only has the purpose of introducing the substance in the chosen points.

The immediate reaction of the injected substance, in terms of expansion and curing, prevents its migration to faraway areas, where a slow reacting substance may instead arrive. In fact, the slower the expansion reaction is the farther the substance arrives, to the detriment of the precise delimitation of the expansion effect and with consequent increase of the injection substance consumption.

Advantageously, since in the conditions of the invention the consolidation has a focused effect with low substance consumption, injection tubes may be used providing sufficient injection substance flow rates which have an inner diameter, for example of 10 mm, thus being easily insertable into and retractable from the soil. Tube diameters being smaller or larger by some millimeters are also usable. Anyway employing tubes with much larger diameters, of about 2 cm or more, difficult to drive into the soil, for obtaining high substance flow rates is not necessary.

To efficiently localize the effect of the consolidation, the injection may be carried out, with intermediate pauses. For example injection periods of 15 seconds may be alternated with pauses of 1–2 seconds or even longer. The durations of the active injection and respectively of the alternating pause periods are in fact selectable to be the more suitable considering factors such as the injection depth, the injection substance composition the length and the cross section of the injection tubes.

For obtaining a more rapid expansion reaction of the injected substance without having to switch to other compositions, where necessary, it is possible to raise by heating the temperature of the substance just before the injection operation.

As regards the hole depth, two different methods can be performed.

A first method consists in treating the entire thickness of the soil layers which are compressible or have a low bearing capacity, so as to perform consolidation up to the solid horizon of the layers having a sufficient bearing capacity, regardless of their depth. The solid horizon can be detected by means of geotechnical research conducted on the soil.

The second method instead consists in treating a layer of soil which, for reasons related to technical and/or economic convenience, does not reach down to the identified solid horizon, which might be located at an excessive depth, but is in any case thick enough to distribute the overlying weight over a wider surface. The layer of soil treated with the method according to the invention, by constituting a sufficiently compact, solid, and in any case light layer, can be effectively and broadly supported by the underlying layers of soil, even if those layers would not otherwise have a sufficient bearing capacity.

Until now, injection depth of up to 6 m have been successfully experimented, but with adapted tube cross-sections and accurately controlled substance injection flow rates, greater injection depths may be attained.

The expansion of the injected substance following the chemical reaction of its components is very fast and develops a very high expansion force: up to 40 tons per square meter or even higher.

Figure 5:
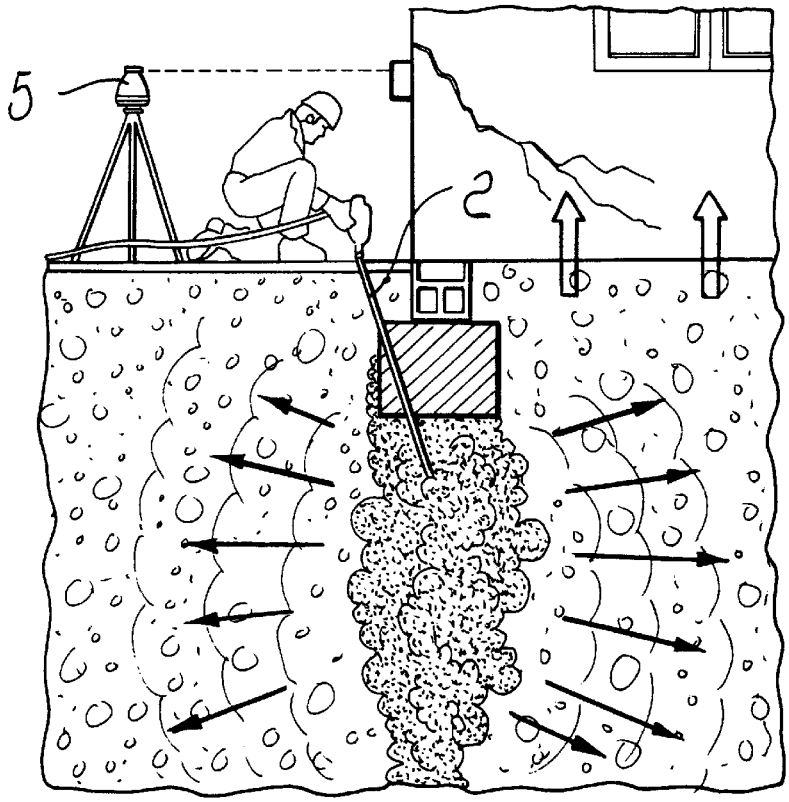
FIG. 5 is a schematic view of an injection operation, according to the invention, with constant monitoring of the sinking recovery of a building foundation.

During injection, the level of the overlying building or of the surface soil can be constantly monitored by means of a laser level 5 or another system (see FIG. 5). When the apparatus 5 indicates that the building or the soil surface begins to rise, this generally means that the compaction of the soil, in three dimensions all around the injection point, has reached very high levels which are generally higher than the required minimum values.

Through the constant monitoring operation, the precise moment when the soil begins rising at a precise spot, due to the narrowly focused expansion force, and further the exact amount of the lifting are accurately detected and may be controlled in real time.

The mass of injected substance, by reacting chemically, in fact expands with great force in all directions, and when the apparatus detects even a small rise at the surface, this means that the expandable substance has encountered less resistance in expanding in the vertical direction with respect to all other directions and that therefore the soil lying below and around the injected substance withstands and "rejects" all the weight (which is dynamic and therefore multiplied) not only of the entire mass of soil (and of any building) which rests statically thereon, but also of all the surrounding mass displaced (by friction and cohesion) at a load diffusion angle which is usually calculated at around 30° and is simply inverted. The raised soil, too, undergoes compression.

By repeating this operation at different depth levels (spaced by approximately 1 meter from each other, but variably according to the kind of soil and to the bearing capacity to be obtained), at each level, a greater bearing capacity is obtained than the required one. By acting in this last manner and by performing continuous injections along rising columns, wherein tree-like shapes are formed with a very irregular configuration, with protrusions, bumps, and projections even of considerable size produced by the different resistance of the soil to compaction and to the possible presence of interstices or fractures in the soil, in any case the entire mass and the treated layer of soil are compressed, packed and compacted; the water content decreases considerably; and the soil becomes a valid foundation soil adapted to stably support the building which lies above or is to be built.

The expandable substance can have a density varying indeed according to the resistance opposed by the surrounding soil to its expansion. In most cases, density can vary between 100 kg/m$^3$ and 300 kg/m$^3$. There may also be higher densities, since the density of the expanded substance is directly proportional to the resistance which it encounters to its expansion. The compression resistance of the expanded substance itself is a function of density.

A substance with a density of 100 kg/m$^3$ offers a resistance of approximately 14 kg/cm$^2$, whilst at a density of 300 kg/m$^3$ compression resistance is approximately 40 kg/cm$^2$. These values are far higher than those normally required for a foundation soil. In any case, where higher compression resistance values are required, even at different depths of the same soil, there is also a greater weight and therefore a higher resistance to expansion; accordingly, a denser and therefore stronger material forms automatically.

In any case, it is possible to momentarily add weight to a soil surface or to a building.

In practice, the injected and hardened expanded substance does not support the overlying building on its own, though helping to achieve this purpose; the weight of the building is effectively supported by the foundation soil treated with the method according to the invention.

In practice it has been observed that the method according to the invention fully achieves the intended aim and objects, since it allows, in a very simple, rapid, effective, and final manner, to increase the bearing capacity of foundation soils until they fully comply with construction requirements.

Typically, in what seems to be a general trend in ground consolidation techniques, see for example the document DE-A-33 32 256, a very rapid expansion, with very high expansion coefficients, creating rapidly increasing pressures in the treated soil, is purposely avoided, since it was shown to provoke unwanted, mainly vertical, fissures in the treated mass ground.

In the conditions of the invention, however, it has surprisingly been noted that fissures occurring between soil masses, not only do not affect the soil compaction, but can in fact be advantageously exploited.

Technical tests and studies, carried out on built lots where the consolidation method of the invention has been used, have demonstrated that the expansion of the injected material occurs first in directions where the soil offers less resistance, but only for a limited extent. In the case of a built spot this happens, in the first place, laterally to the foundation and not in the vertical direction, where the weight of the building acts.

Only after the ground compaction degree is such as to provide a resistance to the lateral expansion forces well exceeding the weight force exerted by the building, a vertical force is obtained such as to raise the foundation and the building. In fact it is not only the weight of the building which has to be compensated for, but also other resistant forces, such as part of the weight of adjacent constructions, lateral friction forces and the flexural strength of the built structure itself.

Figure 9:
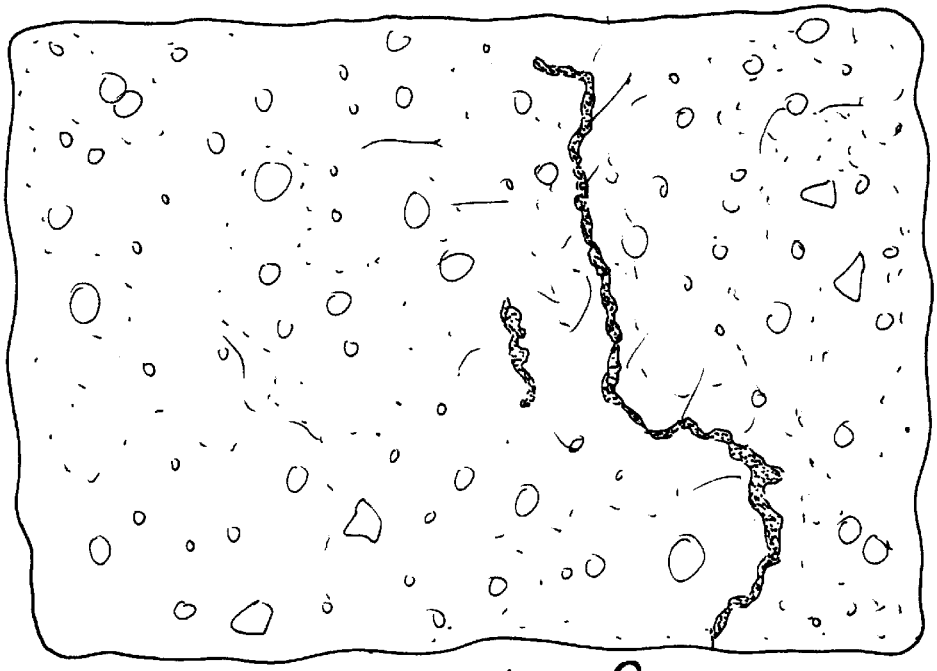
FIG. 9 is a sectional view of a soil area treated in accordance with the invention.

While an immediate reaction of the injected material, in terms of expansion and solidification, may provoke indeed fissures between soil masses forced to move with respect to each other by rapidly increasing, strong forces, a certain quantity of the injected substance appears in fact to fill up the fissures so as to "weld" satisfactory the soil masses, at least in the area to be consolidated, which is immediately close to the injection site and under the foundation of the built structure. For exemplification see FIG. 9, where a "welded" fissure may clearly be seen.

Figure 6:
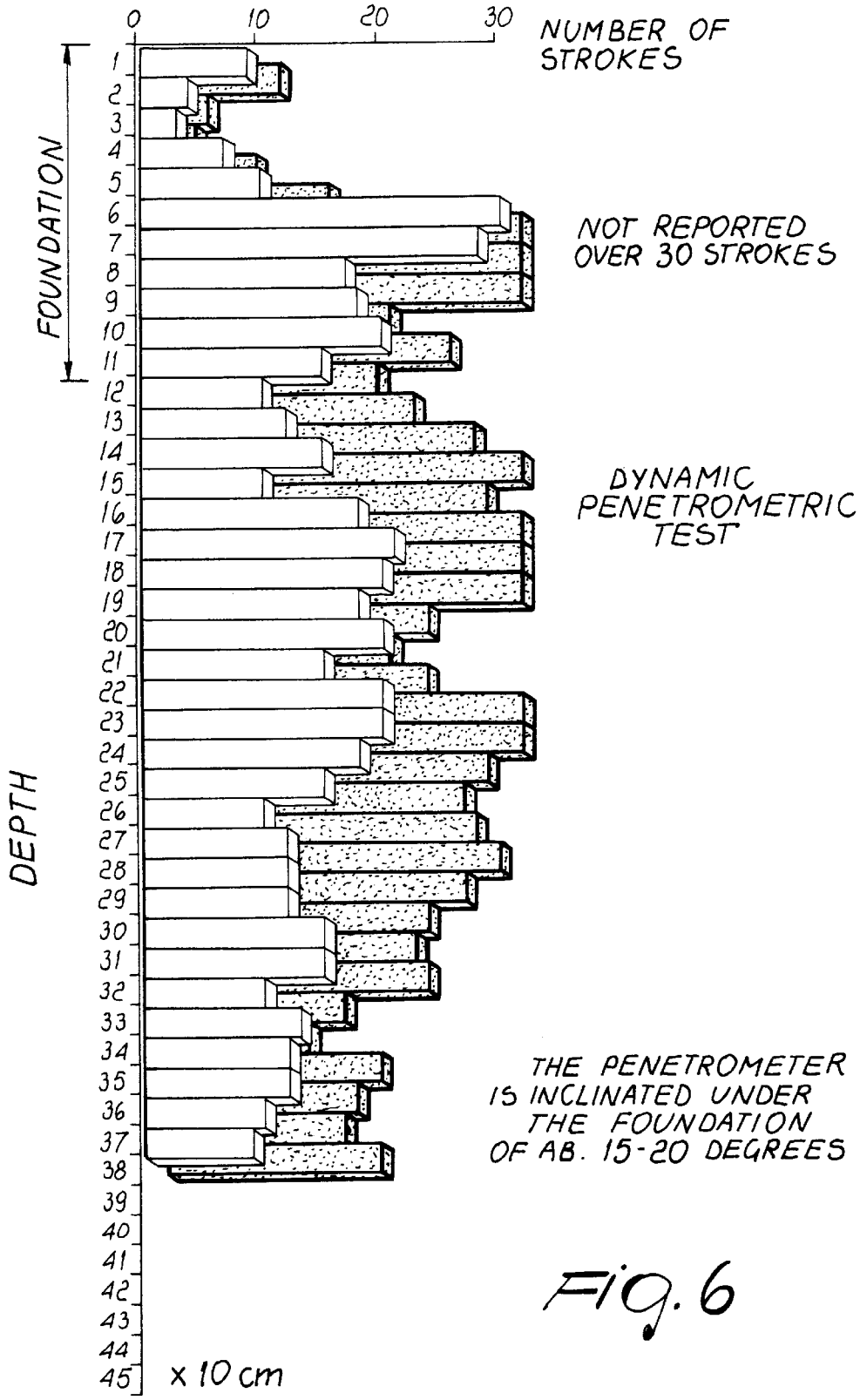
FIGS. 6–8 are comparative diagrams of dynamic penetrometric tests carried out on a soil area treated according to the invention.
Figure 7:
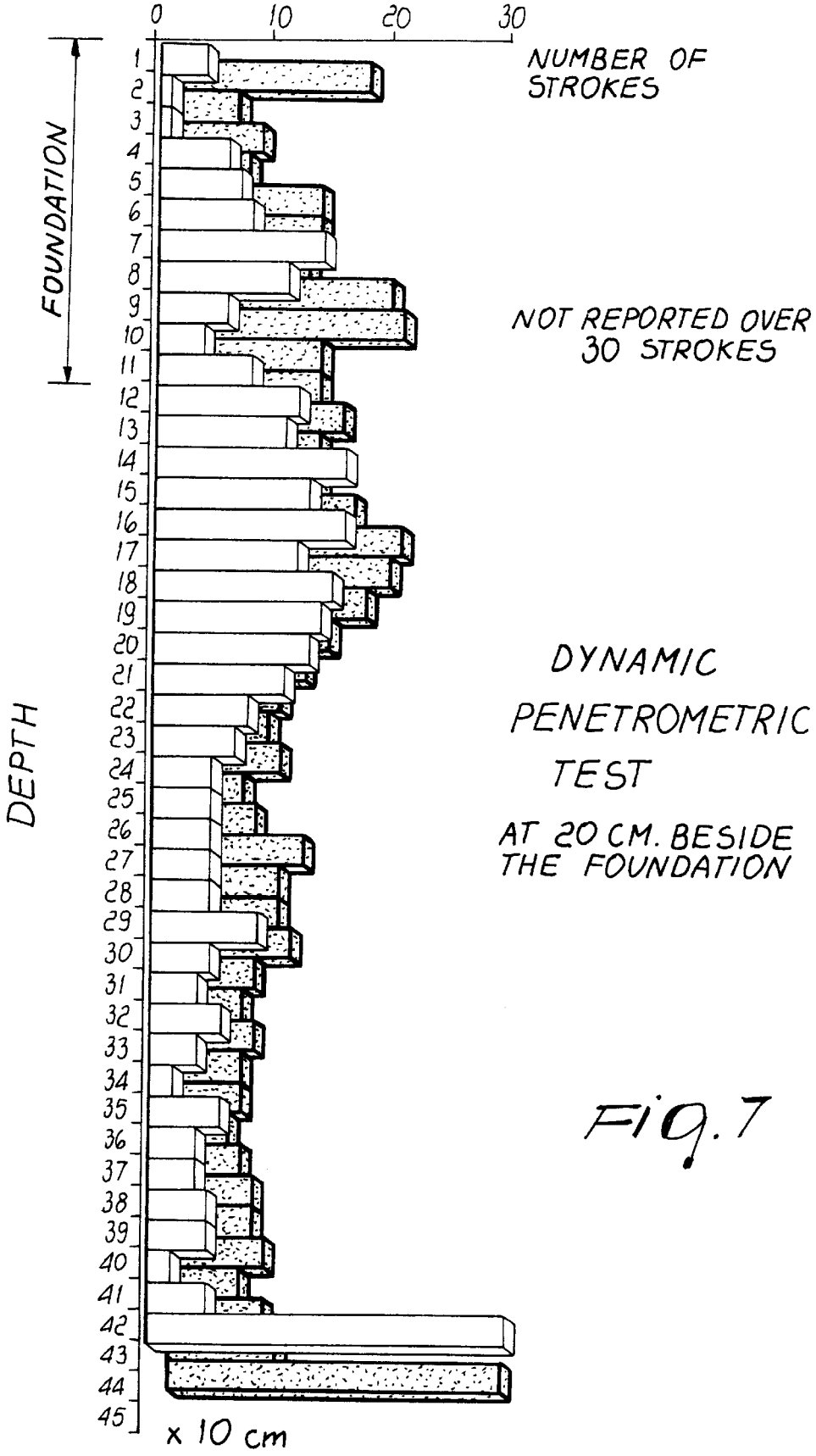
Figure 8:
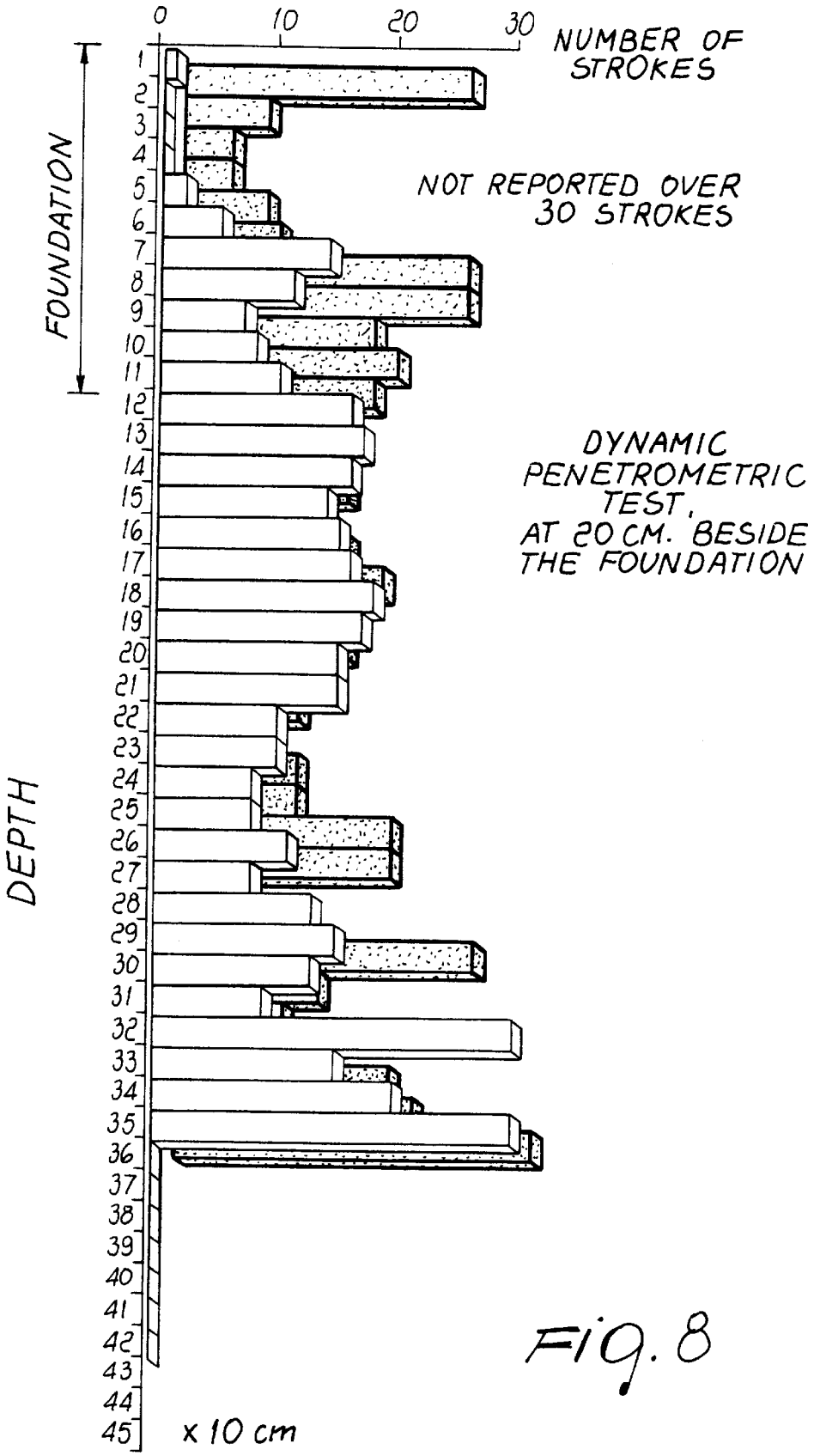

Penetrometric tests, the results whereof are shown in the diagrams of FIGS. 6–8, have been carried out both under built spots treated with the consolidation method according to the invention, after a soil lifting has been sensed by the level apparatus, and laterally thereto, in close vicinity, at about 20 cm from the foundation.

From these diagrams showing comparatively the soil bearing capacity before consolidation (the not shadowed prisms) and after the consolidation (the shadowed prisms), clearly appears that the main consolidation occurs under the foundation, between 120 and about 300 cm of depth (FIG. 6), while at only 20 cm laterally from the foundation, the consolidation appears, at the same depths as before, significantly diminished (FIG. 7).

It is believed that this clearly shows the focused effect of the consolidation carried out according to the invention which practically provides a noteworthy reinforcement of mainly the soil under the foundations.

The diagram of FIG. 8, drawn in the condition where an amount of expandable substance has been injected which has not provoked any detectable lifting reaction of the soil under the building foundation, shows that in fact, laterally, at only 20 cm from the foundation, practically no effective soil compaction has occurred which would have allowed generation of the vertical force necessary to the lifting and thereby also limiting the area where fissures may occur.

The method according to the invention has successfully been applied to consolidate the ground and to compensate subsidences under heavily loaded foundations in airports, such as those of the runaways, in industrial and commercial constructions such as those of roadways and equipment supporting slabs, as well as under very old, historic buildings and at archaeological sites.

Checkings of treated sites have been made recently, and have all given satisfactory results. The inspections have been carried out in accordance with a procedure approved by the French Control Institute SOCOTEC consisting substantially in injecting, at a site selected by an inspector in a treated zone, at random, a small quantity of the injection substance (about 20% of the quantity initially injected). The result has been considered positive if the injection triggered at least a minimum lifting effect of the soil surface.

The method thus conceived is susceptible of numerous modifications and variations, all of which are within the scope of the inventive concept; all the details may furthermore be replaced with other technically equivalent elements.

What is claimed is:

1. A method for increasing the bearing capacity of foundation soils for built a structures comprising: providing a plurality of holes spaced from each other, under the foundation of a built structure, deep in the foundation soil; injecting into the foundation soil, through said holes, a substance which expands as a consequence of a chemical reaction; producing compaction of the foundation soil contiguous to the injection one due to the expansion of said substance injected into the soil; constantly monitoring level variations of the soil and/or built structures overlying the injection zone to detect the moment when the built structures and/or the soil surface, overlying injection zone, begins to raise which is the moment in which the compaction of the foundation soil has reached levels generally higher than a required minimum value at which the soil lying below and around said injection zone withstands and rejects dynamic and static weights exerted thereon by said built structures and by overlying and adjacent soil masses, and wherein the expansion of the injected substance is cry fast with a potential increase in volume of the expanded substance being at least five times the volume of the substance before expansion.

2. A method according to claim 1, wherein the injecting step is repeated at different depth levels for producing compaction of the masses or layers of treated soil.

3. A method according to claim 2, wherein said different depth levels are spaced by approximately 1 m from each other, at each level a greater bearing capacity than the required minimum value being obtainable.

4. A method according to claim 1, wherein said monitoring step is performed with a laser level apparatus.

5. A method according to claim 2, wherein said holes are provided vertically, the injection steps being performed continuously along rising columns wherein tree-like shapes are formed with a very irregular configuration with protrusions, bumps and projections of considerable size produced by different resistance to compaction of the soil, and by the presence of interstices or fractures in the soil.

6. A method according to claim 5, wherein an entire thickness of the soil layers which are compressible or have low bearing capacity is treated so as to perform consolidation up to the solid horizon of the layers having a sufficient bearing capacity regardless of the depth at which the solid horizon is located.

7. A method according to claim 6, wherein the expandable substance is selected from substances adapted to produce immediate expansion.

8. A method according to claim 7, wherein the expandable substance comprises a mixture of two components, the first being a polyether polyol and/or a polyesther polyol, a catalyst and water, and the second being the isocyanate MDI.

9. A method according to claim 5, wherein the distance between two adjacent holes is between 0.5 m and 3 m.

10. A method according to claim 9, wherein said holes are provided at an angle with respect to the vertical.

11. A method according to claim 2, wherein the injection step comprises several active injection phases alternated with suitable pauses.

12. A method according to claim 1, wherein the injection substance is heated just before the injection step.

13. A method according to claim 8, wherein the water content is of 3.44%, by weight.

14. A method according to claim 11, wherein in the injection step, tubes are used through which the expandable substance is injected into the soil, the tubes having an inner diameter of about 10 mm.

15. The method of claim 2, wherein the built structures include any of: buildings, roadway slabs, airport runaways, and equipment supporting slabs.

16. A method according to claim 6, wherein the expandable substance is a substance comprising a mixture of polyols and an isocyanate MDI.

17. A method for increasing the bearing capacity of foundation soils for built structures comprising:

providing a plurality of holes spaced from each other deep in the foundation soil;

providing an expandable substance with very fast expansion time and with a potential increase in volume of the expanded substance being at least five times the volume of the substance before expansion;

injecting into the soil, through said holes, said substance which expands as a consequence of a chemical reaction, the injection being performed continuously along rising columns;

producing compaction of the soil contiguous to each substance injection zone due to expansion of said substance injected into the foundation soil which forms, along said columns, tree-like shapes with irregular configuration including protrusions, bumps and projections produced by different resistance to compaction of the foundation soil and due to voids, interstices or fractures present under said structure and into the foundation soil; and constantly monitoring level variations of the soil surface and/or built structure overlying the injection zone to detect a moment when the built structure and/or the soil surface, overlying said injection zone, begins to raise which is the moment when the compaction of the soil has reached levels generally higher than a required minimum value at which the soil lying below and around said injection zone withstands and rejects dynamic and static weights exerted thereon by said built structures and by and adjacent soil masses.

18. The method of claim 17, wherein said holes are provided in the foundation soil to have a direction selected to be any of a vertical direction and a direction forming an angle with respect to the vertical direction.

19. The method of claim 18, wherein the built structures include any of: buildings, roadway slabs, airport runaways, and equipment supporting slabs.

20. A method for increasing the bearing capacity of foundation soils for built structures comprising:

providing a plurality of holes spaced from each other, under the foundation of a built structure, deep in the foundation soil;

providing an expandable substance with very fast expansion time and with a potential increase in volume of the expanded substance being at least five times the volume of the substance before expansion;

injecting into the soil, through said holes, said substance which expands as a consequence of a chemical reaction;

producing compaction of the soil contiguous to the substance injection zone through expansion of said substance injected into the foundation soil until the soil compaction reaches levels which are generally higher than a minimum compaction value required to provide a bearing capacity of the foundation soil suitable to withstand an dynamic and static weight exerted thereon by the built structures and by overlying and adjacent soil masses; and determining attainment of aid minimum compaction value required by constantly monitoring level variations of the soil surface and/or of the built structure overlying said injection zone to detect a moment when the built structure and/or the soil surface, overlying said injection zone, begins to raise, which is the moment when the soil lying below and around said injection zone withstands and rejects upwardly the dynamic and static weight exerted thereon by said built structures and overlying and adjacent soil masses.

21. The method of claim 20, wherein the built structures include any of: buildings, roadway slabs, airport runaways, and equipment supporting slabs.

22. A method for increasing the bearing capacity of foundation soils for built structures comprising:

establishing appropriate treatment levels located at different depths in a foundation soil requiring bearing capacity increasing, said foundation soil being at least that part of soil having to withstand dynamic and static weights exerted by a built structure and by overlying and adjacent soil masses;

providing a plurality of hole spaced from each other deep in the foundation soil so as to reach said treatment levels;

providing an expandable substance with very fast expansion time and with a potential increase in volume of the expanded substance being at least five times the volume of the substance before expansion;

injecting into the soil, through said holes said substance which expands as a consequence of a chemical reaction;

producing compaction of the soil contiguous to each substance injection zone by way of the expansion of said sub injected into the foundation soil; and estimating the bearing capacity achieved in the foundation soil treated with expanding substance injections by constantly monitoring the level of the soil surface and/or built structure overlying the in injection zone to detect a moment when the built structure and/or the soil surface, overlying zone, begins to raise which is the moment when the compaction of the soil due to the substance expansion has reached levels generally higher a required minimum value at which the soil lying below and around said injection zone withstands and rejects dynamic and static weights exerted thereon by said built structures and by overlying and adjacent soil masses.

23. A method for increasing the bearing capacity of foundation soils for built structures comprising:

establishing appropriate eat levels located at different depths in a foundation soil requiring bearing capacity increasing, said foundation soil being at least that part of soil withstanding dynamic and tic weights exerted by a built structure and by overlying and adjacent soil masses;

providing a plurality of ho spaced from each other deep in the foundation soil so as to reach said treatment levels;

providing an expandable balance with very fast expansion time and with a potential increase in volume of the expanded substance being at least five times the volume of the substance before expansion;

injecting into the soil, through said holes, a quantity of said substance which expands as a consequence of a chemical reaction;

producing compaction of soil contiguous to the substance injection zone by way of the expansion of said quantity of substance injected into the foundation soil until the soil compaction reached levels which are generally higher than a minimum compaction value requiring to provide a bearing capacity of the foundation soil suitable to withstand any dynamic and static weight exerted thereon by the built structures and by overlying and adjacent seen soil masses; and detecting reaching of said urn compaction value required by constantly monitoring level variations of the soil surface and/or of kite built structure overlying said injection zone to detect a moment when the built structure and/or the soil surface, overlying said injection zone, begins to raise, which is the moment when the soil lying below and around said injection withstands and rejects upwardly the dynamic and static weight exerted thereon by said built structures and overlying and adjacent soil masses; and carrying out said expendable substance injection at said treatment levels at least until said minimum compaction value detected through said monitoring is reached.

* * * * *

US006634831C1

(12) EX PARTE REEXAMINATION CERTIFICATE (9037th)

United States Patent

Canteri

(10) Number: US 6,634,831 C1

(45) Certificate Issued: May 29, 2012

(54) METHOD FOR INCREASING THE BEARING CAPACITY OF FOUNDATION SOILS FOR BUILT STRUCTURES

(75) Inventor: Carlo Canteri, Brunate (IT)

(73) Assignee: Benefil Worldwide Oy, Tampere (FI)

Reexamination Request:
No. 90/011,595, Mar. 24, 2011

Reexamination Certificate for:

| | |
|---|---|
| Patent No.: | **6,634,831** |
| Issued: | **Oct. 21, 2003** |
| Appl. No.: | **09/308,962** |
| Filed: | **Sep. 2, 1999** |

(22) PCT Filed: Nov. 27, 1997

(86) PCT No.: PCT/EP97/06619

§ 371 (c)(1),
(2), (4) Date: Sep. 2, 1999

(87) PCT Pub. No.: WO98/24982

PCT Pub. Date: Jun. 11, 1998

(30) Foreign Application Priority Data

Dec. 2, 1996 (IT) ..... MI96A2520

(51) Int. Cl.
*E02D 3/12* (2006.01)
*E02D 3/00* (2006.01)

(52) U.S. Cl. ..... 405/264; 52/742.13; 405/263

(58) Field of Classification Search ..... None
See application file for complete search history.

(56) References Cited

To view the complete listing of prior art documents cited during the proceeding for Reexamination Control Number 90/011,595, please refer to the USPTO's public Patent Application Information Retrieval (PAIR) system under the Display References tab.

*Primary Examiner*—Catherine S. Williams

(57) ABSTRACT

A method for increasing the bearing capacity of foundation soils for built structures consisting of providing a plurality of holes spaced from each other deep in the soil, and injecting into the soil, through the holes, a substance which expands as a consequence of a chemical reaction, with a potential increase in volume of at least five times the volume of the substance before expansion. The expansion of the substance injected into the soil produces compaction of the contiguous soil.

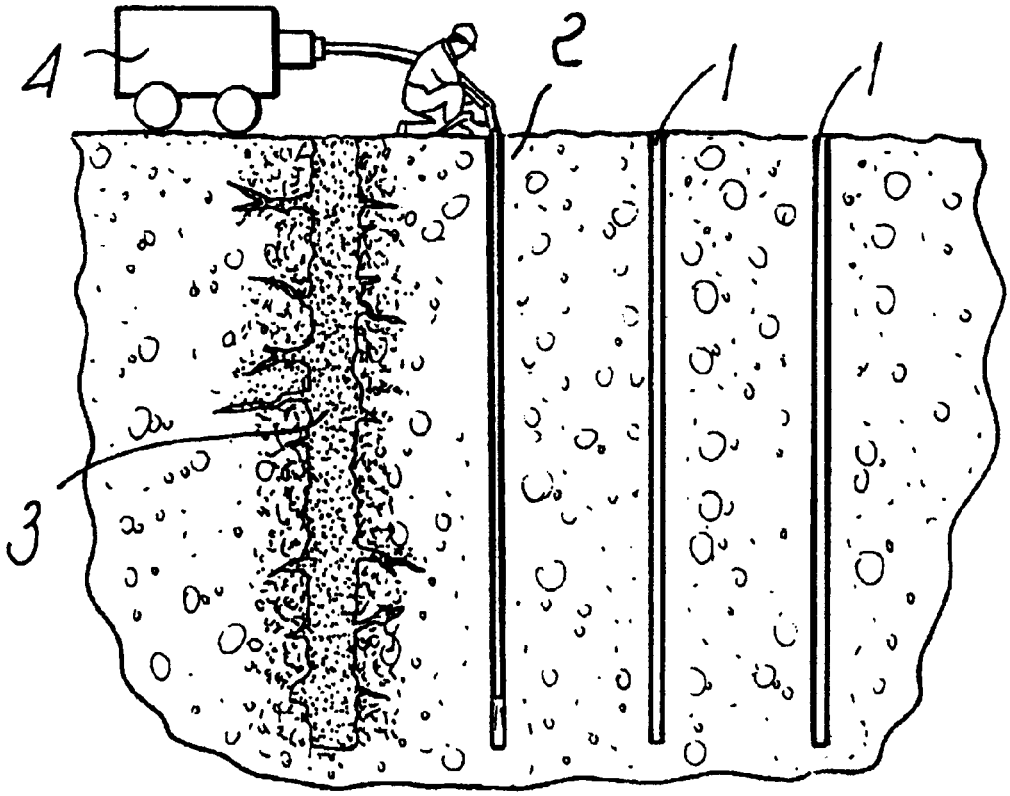

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 17-19 is confirmed.

Claims 1, 20, 22 and 23 are determined to be patentable as amended.

Claims 2-16 and 21, dependent on an amended claim, are determined to be patentable.

1. A method for increasing the bearing capacity of foundation soils for built a structures comprising:

providing a plurality of holes spaced from each other, under the foundation of a built structure, deep in the foundation soil;

injecting into the foundation soil, through said holes, a substance which expands as a consequence of a chemical reaction;

producing compaction of the foundation soil contiguous to the injection [one] *zone* due to the expansion of said substance injected into the soil;

constantly monitoring level variations of the soil and/or built structures overlying the injection zone to detect the moment when the built structures and/or the soil surface, overlying *the* injection zone, begins to raise which is the moment in which the compaction of the foundation soil has reached levels generally higher than a required minimum value at which the soil lying below and around said injection zone withstands and rejects dynamic and static weights exerted thereon by said built structures and by overlying and adjacent soil masses, and wherein the expansion of the injected substance is [cry] *very* fast with a potential increase in volume of the expanded substance being at least five times the volume of the substance before expansion.

20. A method for increasing the bearing capacity of foundation soils for built structures comprising:

providing a plurality of holes spaced from each other, under the foundation of a built structure, deep in the foundation soil;

providing an expandable substance with very fast expansion time and with a potential increase in volume of the expanded substance being at least five times the volume of the substance before expansion;

injecting into soil, through said holes, said substance which expands as a consequence of a chemical reaction;

producing compaction of the soil contiguous to the substance injection zone through expansion of said substance injected into the foundation soil until the soil compaction reaches levels which are generally higher than a minimum compaction value required to provide a bearing capacity of the foundation soil suitable to withstand an dynamic and static weight exerted thereon by the built structures and by overlying and adjacent soil masses; and determining attainment of [aid] *said* minimum compaction value required by constantly monitoring level variations of the soil surface and/or of the built structure overlying said injection zone to detect a moment when the built structure and/or the soil surface, overlying said injection zone, begins to raise, which is the moment when the soil lying below and around said injection zone withstands and rejects upwardly the dynamic and static weight exerted thereon by said built structures and overlying and adjacent soil masses.

22. A method for increasing the bearing capacity of foundation soils for built structures comprising:

establishing appropriate treatment levels located at different depths in a foundation soil requiring bearing capacity increasing, said foundation soil being at least that part of soil having to withstand dynamic and static weights exerted by a built structure and by overlying and adjacent soil masses;

providing a plurality of hole spaced from each other deep in the foundation soil so as to reach said treatment levels;

providing an expandable substance with very fast expansion time and with a potential increase in volume of the expanded substance being at least five times the volume of the substance before expansion;

injecting into the soil, through said holes said substance which expands as a consequence of a chemical reaction;

producing compaction of the soil contiguous to each substance injection zone by way of the expansion of said [sub] *substance* injected into the foundation soil; and estimating the bearing capacity achieved in the foundation soil treated with expanding substance injections by constantly monitoring the level of the soil surface and/or built structure overlying the in injection zone to detect a moment when the built structure and/or the soil surface, overlying zone, begins to raise which is the moment when the compaction of the soil due to the substance expansion has reached levels generally higher a required minimum value at which the soil lying below and around said injection zone withstands and rejects dynamic and static weights exerted thereon by said built structures and by overlying and adjacent soil masses.

23. A method for increasing the bearing capacity of foundation soils for built structures comprising:

establishing appropriate [eat] *treatment* levels located at different depths in a foundation soil requiring bearing capacity increasing, said foundation soil being at least that part of soil withstanding dynamic and [tic] *static* weights exerted by a built structure and by overlying and adjacent soil masses;

providing a plurality of [ho] *holes* spaced from each other deep in the foundation soil so as to reach said treatment levels;

providing an expandable balance with very fast expansion time and with a potential increase in volume of the expanded substance being at least five times the volume of the substance before expansion;

injecting into the soil, through said holes, a quantity of said substance which expands as a consequence of a chemical reaction;

producing compaction of soil contiguous to the substance injection zone by way of the expansion of said quantity of substance injected into the foundation soil until the soil compaction reached levels which are generally higher than a minimum compaction value requiring to provide a bearing capacity of the foundation soil suitable to withstand any dynamic and static weight exerted thereon by the built structures and by overlying and adjacent [seen] soil masses; and detecting reaching of said [urn] *minimum* compaction value required by constantly monitoring level variations of the soil surface and/or of [kite] *the* built structure overlying said injection zone to detect a moment when the built structure and/or the soil surface, overlying said injection zone, begins to raise, which is the moment when the soil lying below and around said injection *zone* withstands and rejects upwardly the dynamic and static weight exerted thereon by said built structures and overlying and adjacent soil masses; and carrying out said [expendable] *expandable* substance injection at said treatment levels at least until said minimum compaction value detected through said monitoring is reached.

* * * * *